United States Patent [19]

Paddock et al.

[11] Patent Number: 4,476,982

[45] Date of Patent: Oct. 16, 1984

[54] METHOD AND APPARATUS FOR GRADING ARTICLES ACCORDING TO THEIR SURFACE COLOR

[75] Inventors: Paul F. Paddock, Riverside; William G. Krage, Fair Oaks; Tim D. Conway, Stockton, all of Calif.

[73] Assignee: Sunkist Growers, Inc., Ontario, Calif.

[21] Appl. No.: 433,245

[22] Filed: Oct. 7, 1982

Related U.S. Application Data

[63] Continuation-in-part of Ser. No. 249,820, Apr. 1, 1981, abandoned.

[51] Int. Cl.[3] ..... B07C 5/342

[52] U.S. Cl. ..... 209/582; 250/226; 356/406; 356/425

[58] Field of Search ..... 209/555, 556, 558, 576, 209/577, 578, 580–582, 587; 250/226; 356/406, 407, 408, 416, 419, 425

[56] References Cited

U.S. PATENT DOCUMENTS

| | | | |
|---|---|---|---|
| Re. 29,031 | 11/1976 | Irving et al. | 209/582 X |
| 2,881,919 | 4/1959 | Bartlett . | |
| 2,933,613 | 4/1960 | Powers | 209/582 X |
| 3,206,022 | 9/1965 | Roberts, Jr. et al. . | |
| 3,867,039 | 2/1975 | Nelson . | |
| 4,095,696 | 6/1978 | Sherwood | 209/581 X |
| 4,105,123 | 8/1978 | Irving et al. | 209/580 X |
| 4,203,522 | 5/1980 | Fraenkel et al. | 209/581 X |
| 4,205,752 | 6/1980 | Malvick et al. | 209/582 X |

*Primary Examiner*—Robert B. Reeves
*Assistant Examiner*—Edward M. Wacyra
*Attorney, Agent, or Firm*—Pretty, Schroeder, Brueggemann & Clark

[57] ABSTRACT

Method and apparatus for grading articles, particularly lemons, according to their surface color. The apparatus measures each lemon's reflectance in infrared, red and green wavelength bands, and computes the ratio of the red and infrared measurements and the ratio of the red and green measurements. If the red/infrared ratio is less than a prescribed crossover threshold, the apparatus compares the red/infrared ratio to a first set of thresholds, to grade the lemon into either a very dark green, dark green or light green color grade. Conversely, if the red/infrared color ratio is greater than the crossover threshold, the apparatus compares the red/green ratio to a second set of thresholds, to grade the lemon into either a silver, tree-ripe or bronzy color grade.

14 Claims, 3 Drawing Figures

METHOD AND APPARATUS FOR GRADING ARTICLES ACCORDING TO THEIR SURFACE COLOR

BACKGROUND OF THE INVENTION

This is a continuation-in-part of application Ser. No. 249,820, filed Apr. 1, 1981 and now abandoned.

This invention relates generally to systems for grading articles according to their surface color, and, more particularly, to color grading systems that compute a color ratio signal for each article and compare this ratio signal to a set of prescribed thresholds, to categorize the article into one of a plurality of color grades.

Color grading systems of this particular type are of special use in grading and sorting fruit, such as lemons, according to surface color. Lemons, for example, are generally picked in varying stages of ripeness and then sorted into about six different color grades, e.g., very dark green, dark green, light green, silver, tree-ripe and bronzy (i.e., over-ripe). Lemons in each color grade are then either marketed immediately or stored for prescribed periods of time before marketing.

In the past, color grading has typically been accomplished by measuring the reflectance of each lemon at two distinct colors or wavelength bands, e.g., red, centered at about 680 nanometers (nm), and infrared, centered at about 730 nm. A ratio of these two reflectance measurements was then computed and compared to a number of prescribed thresholds, to categorize the lemon into its appropriate color grade. Lemons of all color grades have substantially the same reflectance at 730 nm, but have reflectances that vary substantially at 680 nm, which is the wavelength corresponding to its chlorophyll absorption band. An example of one color grading system of this type is provided in U.S. Pat. No. 4,333,062, issued to Tim D. Conway et al and entitled "Method and Apparatus for Measuring the Surface Color of an Article".

Although the grading apparatus described above has functioned well in grading lemons of varying shades of green, it has not proven entirely satisfactory in distinguishing between silver, tree-ripe, and bronzy lemons. This is because the red/infrared reflectance ratio is approximately the same value for all of these latter three color grades.

It should therefore be appreciated that there is still a need for an improved system for grading articles, particularly lemons, according to color, which will provide good separation between articles in all of its possible color grades. The present invention fulfills this need.

SUMMARY OF THE INVENTION

The present invention is embodied in an improved apparatus and related method for grading articles, particularly lemons, according to their surface color. The apparatus includes means for measuring the article's reflectance in two prescribed wavelength bands, and means for computing the ratio of the two reflectance measurements to produce a first color ratio signal. In accordance with the invention, the apparatus further includes means for measuring the article's reflectance in a third prescribed wavelength band, along with means for computing the ratio of the third reflectance measurement and one of the first two reflectance measurements to produce a second color ratio signal, and threshold detector means for selectively comparing either the first or the second ratio signal to a prescribed set of thresholds to grade the article into its appropriate color grades. Special selection means is responsive to at least one of the reflectance measurements, to determine which of the two color ratio signals the threshold detector means compares to its prescribed set of thresholds.

More particularly, the apparatus of the present invention is particularly adapted for grading the surface color of lemons into such color grades as very dark green, dark green, light green, silver, tree-ripe, and bronzy. The three reflectance measurements correspond to the lemon's reflectance in red, infrared and green wavelength bands, centered at about 680, 730 and 550 nm, respectively. The first color ratio signal corresponds to the ratio of the red and infrared measurements, and the second color ratio signal corresponds to the ratio of the red and green measurements. The selection means compares the red/infrared ratio signal to a prescribed crossover threshold, to produce a binary selection signal. If the selection signal is in a first state, the threshold detector means compares the red/infrared ratio signal to a first set of thresholds, to grade the lemon into either the very dark green, dark green or light green color categories. Conversely, if the selection signal is in the opposite state, the threshold detector means compares the red/green ratio signal to a second set of thresholds, to grade the lemon into either the silver, tree-ripe of bronzy color categories.

Other aspects and advantages of the present invention will become apparent from the following description of the preferred embodiment, taken in conjunction with the accompanying drawings, which disclose, by way of example, the preferred embodiment of the invention.

DESCRIPTION OF THE PREFERRED EMBODIMENTS

Figure 1:
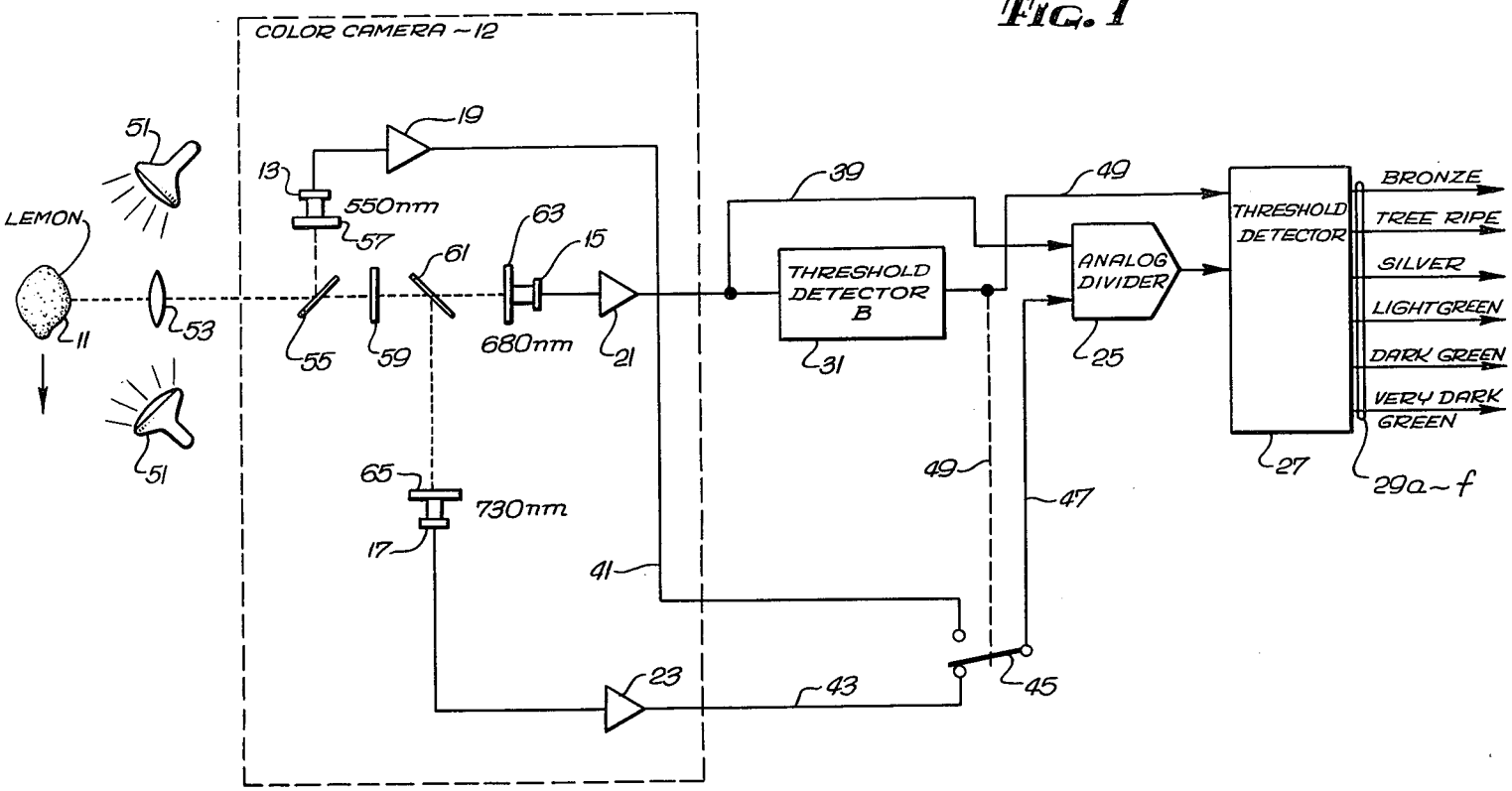
FIG. 1 is a block diagram of a first embodiment of the present invention, for grading lemons according to their surface color.

Referring now to the drawings, and particularly to FIG. 1, there is shown a first embodiment of apparatus for grading lemons 11 according to their surface color. The apparatus includes a color camera 12 for measuring simultaneously the reflectance of each lemon in green, red and infrared wavelength bands, centered at about 550, 680, and 730 nm, respectively, and special circuitry for processing these three measurements to grade each lemon into its appropriate color grade, i.e., very dark green, dark green, light green, silver, tree-ripe, or bronzy.

The color camera 12 includes green, red and infrared photodiodes 13, 15 and 17, respectively, for producing the green, red and infrared reflectance measurements. The apparatus further includes an analog divider 25 for computing the ratio of selected pairs of these reflectance measurements, and a threshold detector A 27 for comparing this computed ratio to a number of prescribed thresholds. The outcomes of these comparisons determines the appropriate color grade for the lemon 11, and a corresponding output signal is produced on the appropriate one of lines *29a–29f*.

In the past, the reflectance measurements coupled to the two input terminals of the analog divider 25 have typically been of the lemon's surface reflectance in red and infrared wavelength bands centered at about 680 nm and 730 nm, respectively. In the apparatus of the present invention, however, the first input terminal receives the red reflectance measurement, and the second input terminal receives either the infrared or the green measurement, depending on the outcome of an initial comparison test.

More particularly, the apparatus includes a threshold detector B 31 for comparing the red reflectance measurement to a prescribed threshold that corresponds to a level midway between the red measurements for light green and silver lemons. If the measurement does not exceed the threshold, the infrared reflectance measurement is coupled to the second input terminal of the analog divider 25, and the apparatus determines that the lemon 11 is properly categorized in a first group of color grades, comprising very dark green, dark green, and light green. The threshold comparator A 27 then compares the resultant red/infrared color ratio signal to a first set of prescribed thresholds, to grade the lemon into the proper one of these color grades. Conversely, if the red reflectance measurement does exceed the threshold, the green measurement is coupled to the second input terminal of the analog divider, and the apparatus determines that the lemon is properly categorized in a second group of color grades, comprising silver, tree-ripe, and bronzy. The threshold comparator A then compares the resultant red/green color ratio signal to a second set of prescribed thresholds, to grade the lemon into the proper one of these latter three color grades.

Figure 2:
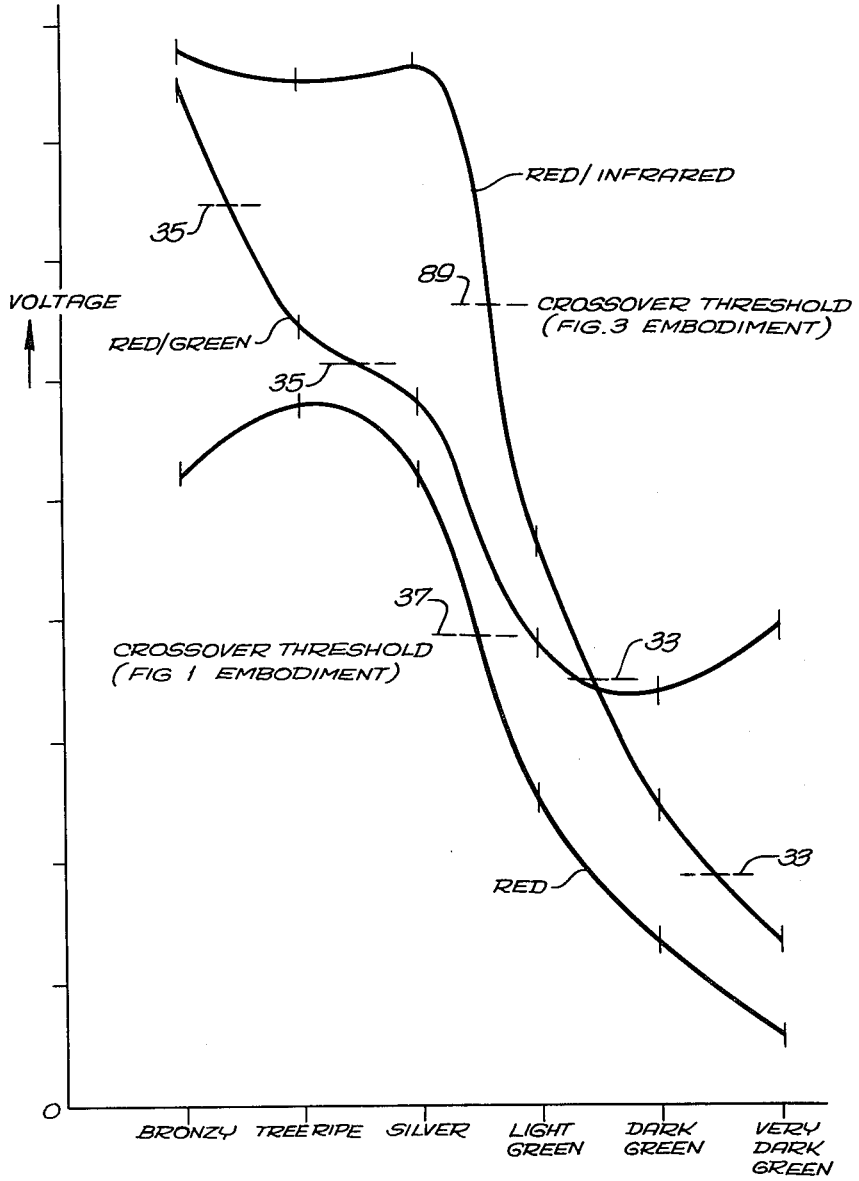
FIG. 2 is a graph of the red reflectance measurement and two color ratio signals produced by the embodiments of both FIG. 1 and FIG. 3, for lemons of various color grades.

Referring now to FIG. 2, there are shown graphs of a typical red reflectance measurement and typical red-/infrared and red/green color ratio signals for lemons having surface colors ranging from very dark green to bronzy. An inspection of the graphs will reveal how the red/infrared ratio signal can be used to grade lemons in the first group of color grades (i.e., very dark green, dark green and light green) and how the red/green ratio signal can be used to grade lemons in the second group of color grades (i.e., silver, tree-ripe and bronzy). It will be observed that the red/infrared color ratio signal is substantially the same for bronzy, tree-ripe, and silver lemons, but decreases continuously for light green, dark green, and very dark green lemons. These latter three color grades therefore can be conveniently separated from each other by selecting the first set of thresholds to be midway between the typical signal values for these grades, as shown diagrammatically at 33.

It will also be observed that the red/green color ratio signal is substantially the same for light green, dark green, and very dark green lemons, but increases continuously for silver, tree-ripe, and bronzy lemons. These latter three color grades therefore can be conveniently separated from each other by selecting the second set of thresholds to be midway between the typical signal values for these grades, as shown diagrammatically at 35.

As previously mentioned, the initial color group determination is made in the first embodiment by comparing the red reflectance measurement to a prescribed threshold selected to be midway between the typical red measurement values for silver and light green lemons. This threshold is shown diagrammatically at 37 in FIG. 2.

With reference again to FIG. 1, the red reflectance measurement is coupled over line 39 from the amplifier 21 to both the threshold detector B 31 and the first input terminal of the analog divider 25. The green and infrared measurements are coupled over lines 41 and 43 from the amplifiers 19 and 23, respectively, to separate input terminals of an analog switch 45, which selects the appropriate measurements for coupling over line 47 to the second input terminal of the analog divider. This selection is controlled by the threshold detector B 31, which outputs a control signal in accordance with the outcome of its comparison of the red reflectance measurement to the threshold 37 (FIG. 2). The control signal is coupled on line 49 to both the analog switch and the threshold detector A 27, to select the appropriate set of thresholds 33 and 35 (FIG. 2) to which the color ratio signal is to be compared.

The apparatus of FIG. 1 further includes a plurality of lamps 51 for illuminating each lemon 11 as it is moved past the apparatus by a conveyor structure (not shown). Suitably conveying apparatus is described in the aforementioned U.S. Pat. No. 4,333,062, which is incorporated herein by reference. Light reflected from each lemon is transmitted through a lens 53 to a first beam splitter 55, where a portion of it is reflected through a 550 nm filter 57 to the green photodiode 13. A second portion of light is transmitted by the first beam splitter through a filter 59 to a second beam splitter 61. A first portion of that light is transmitted by the second beam splitter through a 680 nm filter 63 to the red photodiode 15, and a second portion of the light is reflected by the second beam splitter 61 through a 730 nm filter 65 to the infrared photodiode 17.

The first beam splitter 55 can conveniently be a long wave pass reflector/filter and the second beam splitter 61 can be a hot mirror, both devices available from Mells Griot of Irvine, Calif. The various light filters in the apparatus of FIG. 1 can be selected from any of a number of suitable commercially-available filters, available from such sources as the Schott Optical Co.

Figure 3:
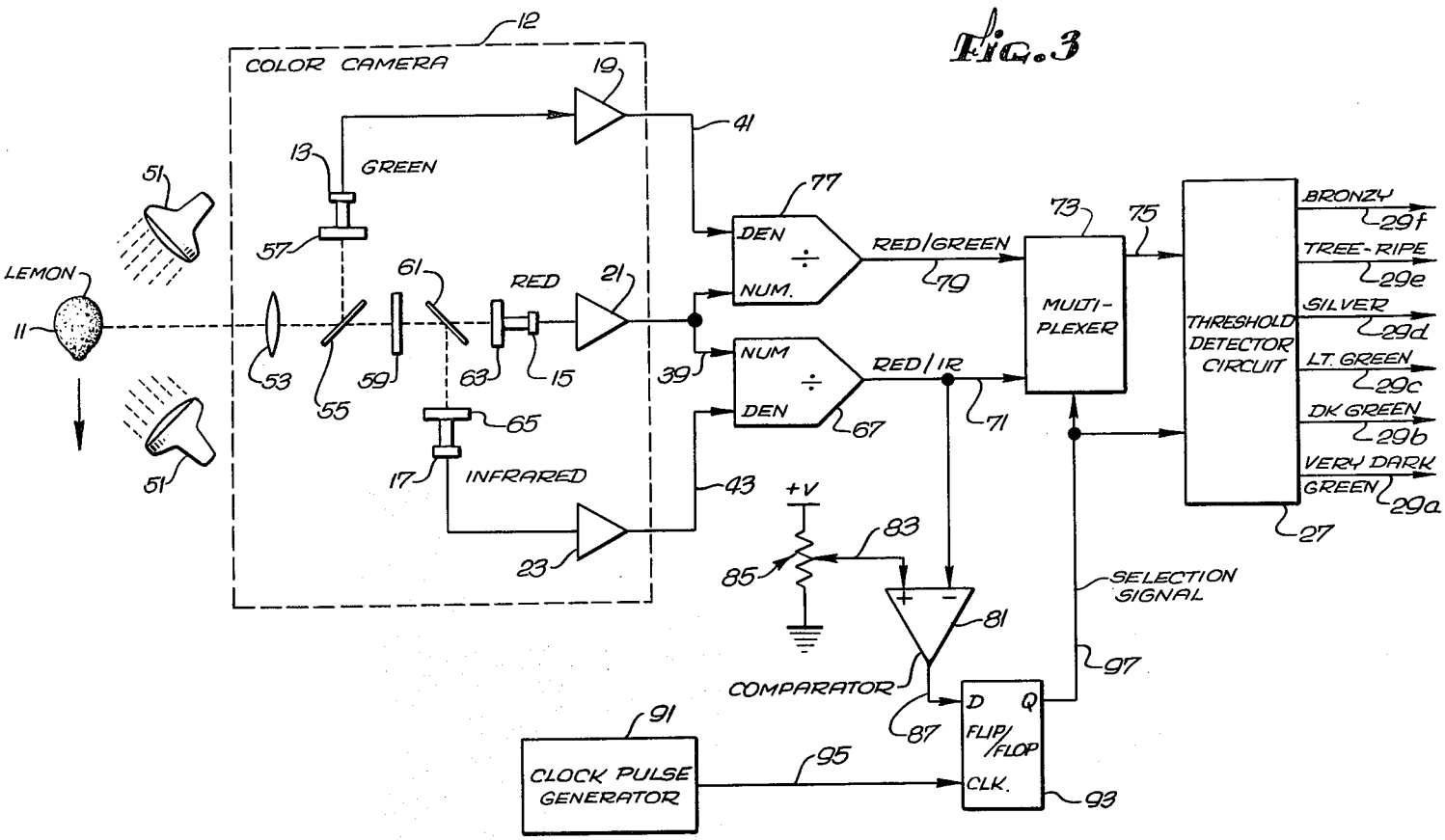
FIG. 3 is a block diagram of a second embodiment of the present invention, for grading lemons according to their surface color.

Referring now to FIG. 3, there is shown a second embodiment of apparatus for grading lemons 11 according to their surface color. Elements of the FIG. 3 embodiment that are identical to those of the FIG. 1 embodiment are identified by corresponding numerals. The FIG. 3 embodiment is less sensitive to variations in the illumination of the lemon 11 being examined. Also, if the field of view of the color camera 12 ever extends beyond the lemon's edges, the FIG. 1 embodiment operates more effectively since in that case the separate reflectance measurements would vary correspondingly and the comparison performed by the threshold detector B 31 of FIG. 1 would be subject to variation.

The FIG. 3 embodiment includes a color camera 12 identical to that of the FIG. 1 embodiment, for producing red, green and infrared reflectance measurements. The embodiment further includes a first analog divider 67 and a threshold detector circuit 27, for use in grading very dark green, dark green and light green lemons. The red and infrared reflectance measurements are coupled over lines 39 and 43, respectively, from the color camera 12 to the divider's numerator and denominator input terminals, such that the divider produces a red/infrared color ratio signal. As shown in FIG. 2, this ratio signal has substantially different values for very dark green, dark green and light green lemons.

The red/infrared ratio signal is coupled over line 71 from the divider to one input terminal of a multiplexer 73, whose function is described below, and in turn over line 75 to the threshold detector circuit 27, where it is compared to a first set of thresholds, designated by the numeral 33 in FIG. 2. Depending on the outcome of these comparisons, the circuit outputs a digital signal on one of lines 29*a*–29*c*, to indicate the lemon's appropriate color grade, i.e., very dark green, dark green or light green.

As previously mentioned, the red/infrared color ratio signal has, unfortunately, not proven to be an effective indicator of silver, tree-ripe or bronzy lemons. This is because lemons in these three color grades normally all produce red/infrared ratio signals having about the same value, as illustrated in FIG. 2.

In accordance with the invention, the embodiment of FIG. 3 further includes a second analog divider 77 for producing a red/green color ratio signal that is coupled to the threshold detector circuit 27 for use in grading silver, tree-ripe and bronzy lemons. In particular, the red and green reflectance measurements are coupled over lines 39 and 41, respectively, from the color camera 12 to the second divider's numerator and denominator input terminals. The resultant red/green ratio signal is coupled over line 79 from the divider to a second input terminal of the multiplexer 73, which relays it over line 75 to the threshold detector circuit whenever it is determined that a silver, tree-ripe or bronzy lemon is being inspected. The threshold detector circuit then compares the red/green ratio signal to a second set of thresholds and outputs a digital signal on one of lines 29*d*–29*f*, to indicate the lemon's appropriate color grade, i.e., silver, tree-ripe or bronzy.

The apparatus further includes a comparator 81 for use in determining whether the lemon 11 under inspection is in the group including very dark green, dark green and light green lemons or in the group including silver, tree-ripe and bronzy lemons. The red/infrared ratio signal is coupled on line 71 from the first divider 67 to the comparator's negative input terminal, and a selectable reference voltage is coupled on line 83 from the wiper of a potentiometer 85 to the comparator's positive input terminal. The comparator therefore outputs a binary selection signal on line 87 that is in a first stage if the red/infrared ratio signal exceeds the reference voltage and in a second state if the ratio signal does not exceed the voltage.

The reference voltage produced by the potentiometer 85 is selected such that the red/infrared ratio signal exceeds it for silver, tree-ripe and bronzy lemons and does not exceed it for very dark green, dark green and light green lemons. With reference to FIG. 2, it should be observed that this reference voltage is designated as a crossover threshold 89 and lies approximately midway between the typical voltage levels of the red/infrared ratio signal for light green and silver lemons.

The apparatus of FIG. 3 further includes a clock pulse generator 91 and a flip/flop 93 for sampling the selection signal output by the comparator 81 at an appropriate time, when all three reflectance measurements are stabilized. In particular, the clock pulse generator is synchronized with the conveyor means (not shown) moving the lemons 11 past the color camera 12, such that it outputs a clock pulse on line 95 when a lemon is within the camera's field of view. The clock pulse triggers the flip/flop to read the selection signal input to it on line 87 from the comparator 81, thereby storing the signal until the next lemon (not shown) moves into the camera's field of view.

The stored selection signal is coupled on line 97 from the flip/flop 93 to the multiplexer 73, to appropriately select either the red/infrared or red/green color ratio signal. The stored selection signal is also coupled to the threshold detector circuit 27, to indicate whether the circuit is to compare the selected ratio signal to the first set of thresholds or the second set of thresholds. The threshold detector circuit then outputs a digital signal on the appropriate one of lines 29*a*–29*f*, indicating the lemon's color grade.

The invention described above can be readily incorporated into a color grading system like that described in the aforementioned U.S. Pat. No. 4,333,062, which includes four color cameras for inspecting substantially the entire surface of each lemon. Each camera views a narrow strip on the lemon as it is moved by a conveyor means, and the color of each strip is determined in a sequential fashion. These separate color determinations are then averaged, or otherwise processed, as described in the patent.

It should be appreciated from the foregoing description that the present invention provides an effective method and apparatus for grading the surface color of articles, particularly lemons, into one of a plurality of separate color grades. The apparatus measures each lemon's reflectance at three distinct wavelengths, and computes two color ratio signals based on those measurements. If a first one of the two ratio signals is less than a prescribed crossover threshold, it is compared to a first set of thresholds, to grade the lemon into either a very dark green, dark green or light green color grade. Conversely, if the first ratio signal is greater than the cross-over threshold, the second ratio signal is compared to a second set of thresholds, to grade the lemon into either a silver, tree-ripe or bronzy color grade.

Although the invention has been described in detail with reference to the presently preferred embodiment, it should be understood by those of ordinary skill in the art that various modifications can be made, without departing from the invention. Accordingly, the invention is limited only by the appended claims.

We claim:

1. Apparatus for grading the surface color of an article into one of a plurality of color grades, comprising:

means for measuring the reflectance of the surface of an article in each of three distinct wavelength bands, to produce first, second and third reflectance measurements;

means for computing the ratio of the first and second reflectance measurements to produce a first color ratio signal, and for computing the ratio of the first and third reflectance measurements to produce a second color ratio signal;

means for selecting one of the two color ratio signals in a prescribed fashion; and threshold detector means for comparing the selected color ratio signal to at least one prescribed threshold, the outcome of the comparison determining the appropriate color grade of the article.

2. Apparatus as defined in claim 1, wherein the first, second and third reflectance measurements correspond to the reflectance of the article in red, infrared and green wavelength bands, respectively.

3. Apparatus as defined in claim 2, wherein the article to be graded is a lemon.

4. Apparatus as defined in claim 1, wherein the means for selecting compares a prescribed one of the two color ratio signals to a prescribed crossover threshold and selects either the first or second color ratio signal depending on the outcome of the comparison.

5. Apparatus for grading the surface color of an article into one of a plurality of color grades, comprising:

means for measuring the reflectance of an article in each of three distinct wavelength bands, to produce first, second and third reflectance measurements;

selecting means responsive to at least one of the three reflectance measurements, for producing a binary selection signal;

ratio means for producing a color ratio signal that corresponds to the ratio of the first and second reflectance measurements if the selection signal is in a first state, or the ratio of the first and third reflectance measurements if the selection signal is in a second state; and threshold detector means for comparing the color ratio signal to at least one prescribed threshold, the outcome of the comparison indicating the color grade of the article.

6. Apparatus as defined in claim 5, wherein the first, second and third reflectance measurements correspond to the reflectance of the article in red, infrared and green wavelength bands, respectively.

7. Apparatus as defined in claim 6, wherein the article to be graded is a lemon.

8. Apparatus for grading the surface color of a lemon into one of a plurality of color grades, comprising:

means for measuring the reflectance of a lemon in red, infrared and green wavelength bands, to produce red, infrared and green reflectance measurements, respectively;

means for computing the ratio of the red and infrared reflectance measurements to produce a red/infrared ratio signal and the ratio of the red and green reflectance measurements to produce a red/green ratio signal;

means for comparing a prescribed one of the two ratio signals to a prescribed crossover threshold, to produce a binary selection signal in accordance with the outcome of the comparison;

means for selecting either the red/infrared ratio signal or the red/green ratio signal in accordance with the selection signal; and threshold detector means for comparing the selected ratio signal to a prescribed set of thresholds, the outcome of the comparisons indicating the appropriate color grade of the lemon.

9. A method for grading the surface color of an article into one of a plurality of color grades, comprising steps of:

measuring the reflectance of the surface of an article in each of three distinct wavelength bands, to produce first, second and third reflectance measurements;

computing the ratio of the first and second reflectance measurements to produce a first color ratio signal, and computing the ratio of the first and third reflectance measurements to produce a second color ratio signal;

selecting one of the two color ratio signals in a prescribed fashion; and comparing the selected color ratio signal to at least one prescribed threshold, the outcome of the comparison determining the appropriate color grade of the article.

10. A method as defined in claim 9, wherein:

the article to be graded is a lemon; and the first, second and third reflectance measurements produced in the step of measuring correspond to the reflectance of the article in red, infrared and green wavelength bands, respectively.

11. A method as defined in claim 9, wherein the step of selecting includes steps of comparing a prescribed one of the two color ratio signals to a prescribed crossover threshold and selecting either the first or second color ratio signal depending on the outcome of the comparison.

12. A method for grading the surface color of an article into one of a plurality of color grades, comprising steps of:

measuring the reflectance of an article in each of three distinct wavelength bands, to produce first, second and third reflectance measurements;

producing a binary selection signal in accordance with at least one of the three reflectance measurements;

producing a color ratio signal that corresponds to the ratio of the first and second reflectance measurements if the selection signal is in a first state, or the ratio of the first and third reflectance measurements if the selection signal is in a second state; and comparing the color ratio signal to at least one prescribed threshold, the outcome of the comparison indicating the color grade of the article.

13. A method as defined in claim 12, wherein:

the article to be graded is a lemon; and the first, second and third reflectance measurements produced in the step of measuring correspond to the reflectance of the article in red, infrared and green wavelength bands, respectively.

14. A method for grading the surface color of a lemon into one of a plurality of color grades, comprising steps of:

measuring the reflectance of a lemon in red, infrared and green wavelength bands, to produce red, infrared and green reflectance measurements, respectively;

computing the ratio of the red and infrared reflectance measurements to produce a red/infrared ratio signal, and computing the ratio of the red and green reflectance measurements to produce a red/green ratio signal;

comparing a prescribed one of the two ratio signals to a prescribed crossover threshold, to produce a binary selection signal in accordance with the outcome of the comparison;

selecting either the red/infrared ratio signal or the red/green ratio signal in accordance with the selection signal; and comparing the selected ratio signal to a prescribed set of thresholds, the outcome of the comparisons indicating the appropriate color grade of the lemon.

* * * * *